US008087341B2

(12) United States Patent
Adler

(10) Patent No.: US 8,087,341 B2
(45) Date of Patent: Jan. 3, 2012

(54) PERSONAL PROTECTION APPARATUS FOR VEHICLES

(76) Inventor: Duff Adler, Yishuv Nokdim (IL)

( * ) Notice: Subject to any disclaimer, the term of this patent is extended or adjusted under 35 U.S.C. 154(b) by 132 days.

(21) Appl. No.: 12/478,118

(22) Filed: Jun. 4, 2009

(65) Prior Publication Data

US 2009/0301290 A1 Dec. 10, 2009

(30) Foreign Application Priority Data

Jun. 5, 2008 (IL) ..... 191961

(51) Int. Cl.
*F41H 7/02* (2006.01)

(52) U.S. Cl. ..... 89/36.08

(58) Field of Classification Search ..... 89/36.01, 89/36.08, 36.07, 36.09; 296/85, 187.05, 296/1.07; 180/271; 280/748, 751, 753
See application file for complete search history.

(56) References Cited

U.S. PATENT DOCUMENTS

| | | | | | |
|---|---|---|---|---|---|
| 1,461,478 | A | * | 7/1923 | Daniels | 296/95.1 |
| 1,462,127 | A | * | 7/1923 | Sanders | 296/95.1 |
| 1,940,444 | A | * | 12/1933 | Burgman | 296/108 |
| 2,726,054 | A | * | 12/1955 | Tompkins et al. | 244/121 |
| 2,959,382 | A | * | 11/1960 | Turner | 244/122 AG |
| 3,026,140 | A | * | 3/1962 | Schutte | 296/89 |
| 3,262,716 | A | * | 7/1966 | Graham | 280/751 |
| 3,510,164 | A | * | 5/1970 | Setina | 296/24.46 |
| 3,666,313 | A | * | 5/1972 | Halstead et al. | 296/24.46 |
| 3,724,323 | A | * | 4/1973 | Selle | 89/36.14 |
| 3,922,034 | A | * | 11/1975 | Eggert | 297/216.12 |
| 4,159,669 | A | * | 7/1979 | Jackson et al. | 89/36.14 |
| 4,355,562 | A | * | 10/1982 | Sewell et al. | 89/36.02 |
| 4,424,736 | A | * | 1/1984 | Byrne | 89/36.05 |
| 4,643,477 | A | * | 2/1987 | Kovatch | 296/96.21 |
| 4,934,246 | A | * | 6/1990 | Benson et al. | 89/36.14 |
| 5,164,536 | A | * | 11/1992 | Barbaza et al. | 89/36.11 |
| 5,307,725 | A | * | 5/1994 | Desmond et al. | 89/36.14 |
| 5,448,938 | A | * | 9/1995 | Fernandez et al. | 89/36.02 |
| 5,487,323 | A | * | 1/1996 | Madden, Jr. | 89/36.08 |
| 5,658,039 | A | * | 8/1997 | Bennett | 296/180.5 |
| 5,747,721 | A | * | 5/1998 | Speakes et al. | 89/36.11 |
| 5,811,719 | A | * | 9/1998 | Madden, Jr. | 296/146.7 |
| 5,857,730 | A | * | 1/1999 | Korpi et al. | 296/146.1 |
| 5,954,384 | A | * | 9/1999 | Jones | 296/95.1 |
| 6,073,884 | A | * | 6/2000 | Lavergne | 244/122 R |
| 6,129,974 | A | * | 10/2000 | Woll | 428/192 |
| 6,164,181 | A | * | 12/2000 | Bruner | 89/36.02 |
| 6,382,711 | B2 | * | 5/2002 | Martin, Jr. | 296/190.08 |
| 6,394,492 | B1 | * | 5/2002 | Corbett | 280/751 |
| 6,588,705 | B1 | * | 7/2003 | Frank | 244/118.5 |
| 6,647,857 | B1 | * | 11/2003 | Newkirk | 89/36.08 |
| 6,767,044 | B2 | * | 7/2004 | Tohda et al. | 296/107.01 |

(Continued)

FOREIGN PATENT DOCUMENTS

WO WO 9429665 A1 * 12/1994

*Primary Examiner* — Troy Chambers
(74) *Attorney, Agent, or Firm* — Lucas & Mercanti, LLP

(57) ABSTRACT

The invention provides a personal protection apparatus for use in vehicles comprising: a behind-the-seat ballistic shield provided with support means extending to the floor of the vehicle for distributing a weight component of the shield, and a deployable protective ballistic shield and visor articulately linked to the behind-the-seat ballistic shield for protecting the upper chest, neck and head areas of a driver and displaceable between an active deployed position in front of the driver and a storage position.

13 Claims, 4 Drawing Sheets

U.S. PATENT DOCUMENTS 6,793,291 B1 * 9/2004 Kocher ..... 297/464
6,964,219 B2 * 11/2005 Gilon ..... 89/36.08
7,114,760 B2 * 10/2006 Cameron ..... 296/152
7,213,882 B2 * 5/2007 Dryburgh et al. ..... 297/354.13
7,225,718 B1 * 6/2007 Grove et al. ..... 89/36.09
7,475,928 B1 * 1/2009 Clum et al. ..... 296/1.04
7,493,844 B2 * 2/2009 Martin ..... 89/36.07
7,681,485 B2 * 3/2010 Neal ..... 89/36.02
7,727,914 B2 * 6/2010 Chiou ..... 442/134
7,789,010 B2 * 9/2010 Allor et al. ..... 89/36.03
7,810,422 B2 * 10/2010 David et al. ..... 89/36.08
2003/0085322 A1 * 5/2003 Weekly ..... 244/118.5
2004/0066082 A1 * 4/2004 Mears et al. ..... 297/452.12
2004/0144243 A1 * 7/2004 Newkirk ..... 89/36.01
2004/0255769 A1 * 12/2004 Drackett ..... 89/36.09
2005/0062304 A1 * 3/2005 Murray et al. ..... 296/24.42
2006/0243126 A1 * 11/2006 Tyler ..... 89/36.01
2008/0190279 A1 * 8/2008 David et al. ..... 89/36.08
2008/0303308 A1 * 12/2008 Hanson et al. ..... 296/146.16
2009/0044695 A1 * 2/2009 Benjamin et al. ..... 89/36.08

* cited by examiner

PERSONAL PROTECTION APPARATUS FOR VEHICLES

CROSS-REFERENCE TO RELATED APPLICATION

This application claims the benefit of priority from Israeli Patent Application Serial Number 191,961 filed Jun. 5, 2008, the contents of which are incorporated herein by reference.

FIELD OF THE INVENTION

The present invention relates to armor protection of drivers and occupants in a vehicle.

More particularly, the invention provides an armor shield at the rear of a driver and a storable visor in front of the driver.

In the present text the words "pilot" or "driver" are used for brevity. These words are intended to also include any occupants of the vehicle.

BACKGROUND OF THE INVENTION

Armor protection is needed in vehicles which are to be driven in dangerous areas. Armored automobiles have been available for several decades, being manufactured by the BMU Co. in Germany and others. Such vehicles are used by heads of state, presidents, heads of large organizations and anyone who is prepared to pay the high cost thereof. The high cost of such vehicles results from the efforts needed to make room for armor and attempts at minimizing the loss of performance inevitably resulting from the increased vehicle weight. In sea vessels and military equipment such as tanks the extra weight is usually accepted. For automobiles the extra weight increases fuel consumption at a time when crude oil has reached a price of around $100 per barrel. Armor has been tried for the protection of vital areas of an aircraft and helicopter, although any attempt at complete armoring results in an aircraft which is useless due to its high weight.

These conditions have led to the conclusion that armoring the complete vehicle is impractical in many civilian land vehicles and all aircraft. Users understand that an automobile is not an APC (Armored Personnel Carrier) and that protection is confined to small arms fire, shell fragments, stones and other small projectiles. The armor used is restricted to protection of its most vital part—the driver or pilot thereof. After all, it is possible to continue using most vehicles even after a few bullets have punctured the outer skin thereof. Thus personal driver or pilot armor systems have been developed, these requiring armor coverage of a much smaller area, and hence imposing an acceptable weight penalty.

An additional consideration is cost. For lowest cost, armor is made of steel, preferably of a projectile-resistant grade. In applications where low weight is a more important consideration than cost, armor is made with a synthetic plastic fiber, e.g. Kevlar, or/and with a multitude of small ceramic pellets held in an array by a cast matrix. Reducing the area to be protected by positioning the armor close to an essential component, or close to the person to be protected reduces the area of armor needed and thus brings both weight and cost within acceptable limits. An extreme close-to-body armor is seen in U.S. Pat. No. 6,793,291 to Kocher. This patent proposes a variety of means for transferring the weight of the armor from the body of the driver/passenger directly to the vehicle. No head protection is seen. A further problem—users are of different sizes and the armor would need to be tailored to each user.

Prior art armoring of vehicles is seen, for example, in U.S. Pat. No. 4,643,477 to Kovatch who discloses a device wherein a sheet of transparent armor may be slid into position behind a standard windshield. The '477 patent does not offer protection from side fired ballistic threats or from high angle ballistic threats (fired through the top front portion of the roof from assailant above). More importantly the weight of and the multiplicity of parts of such armor would preclude its being practical for most uses to deploy or move from vehicle to vehicle. In addition the use of such panels involves extensive mounting apparatus. As is known, drilling a single hole in a new automobile voids the manufacturer's guarantee.

Barbaza et al. disclose a composite armored seat in U.S. Pat. No. 5,164,536. The seat is primarily intended for use in helicopters, has no front shield, and is not removable by the user.

A removable bullet-resistant apparatus is disclosed by Madden, Jr. in U.S. Pat. No. 5,487,323. Provision is made for armoring the windshield and the rear windows, which would require a different size for every car model. No provision is made for armoring the rest of the vehicle.

Madden proposes in U.S. Pat. No. 5,811,719 to provide a flexible bullet-resistant curtain made of an aramid fiber is disposed in the hollow door of the vehicle.

A further armored seat, also for helicopters is seen in U.S. Pat. No. 6,073,884 to Layergne. The armor is not readily removable and no visor is seen.

U.S. Pat. No. 6,164,181 to Bruner discloses a vehicle seat ballistic shield to protect passenger sitting on a seat from rearward originating projectiles. There is no provision for protection against projectiles fired from other angles.

U.S. Pat. No. 6,647,857 to Newkirk discloses a bullet-protective shield mounting to the back side of a sun visor of a motor vehicle. This shield however provides protection from forward or side originating threats depending on the position of the pivot arm and will provide very limited protection for the user. In addition both the weight of effective bullet resistant materials would require extensive changes to the vehicles visors in order to support such an apparatus.

Similarly, in US 2006/0243126, there is described a personal armor system comprising a plurality of armor components, wherein each component is configured for selective use in a plurality of different roles including in different types of vehicles. Among the many armor components described in said application there is described a sun visor armor component which is defined as an armor component which may be mounted behind or in front of the flip down sun visor, said sun visor protector being described therein as having a size of about 22 cm×13 cm and a weight of about 0.87 kg.

Also described in said application are window armor components comprising oblong panels of transparent or grid material which are stuck to the windows by mechanical fixings in addition to conventional suction fixings.

Missing in the prior art is a protective system which can be used fully deployed in dangerous areas, providing good coverage of the chest, neck and head areas of the user, and can easily be removed when the vehicle is to be used in safe areas.

SUMMARY OF THE INVENTION

It is therefore the object of the present invention to obviate the disadvantages of prior art personal armor systems for use in vehicles and to provide a visor connected to the main component of the body shield to increase the possibility of surviving a projectile fired from a location before or above the vehicle.

More specifically, the present invention strives for a practical and economical method to create an internal sphere providing a degree of protection and an ease of deployment that is not previously known in the art wherein the emphasis is on also protecting the head, neck and upper body portions of the user which are the most vulnerable to attack as well as being the most exposed to the angles from which a direct fire threat are likely to originate.

A further object of the invention is to provide a shielding assembly which is adaptable for attachment to a wide variety of vehicles.

DETAILED DESCRIPTION OF THE INVENTION

Figure 1A:
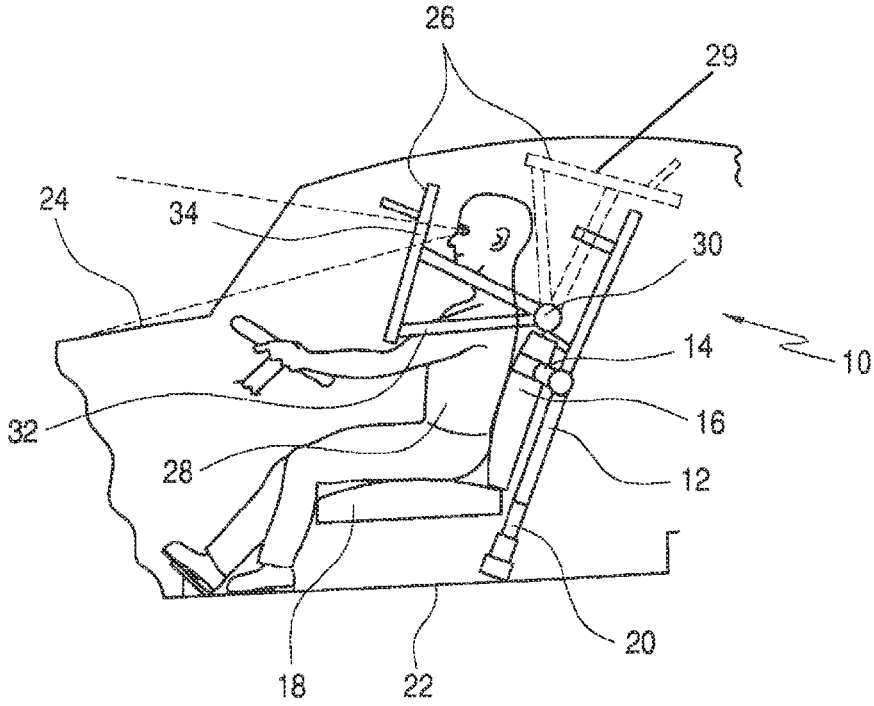
FIG. 1*a* is an elevational view of a preferred embodiment of the apparatus according to the invention.

The present invention achieves the above objects by providing a personal protection apparatus for use in vehicles comprising a behind-the-seat ballistic shield provided with support means extending to the floor of said vehicle for distributing a weight component of said shield, and a deployable protective ballistic shield and visor articulately linked to said behind-the-seat ballistic shield for protecting the upper chest, neck and head areas of a driver and displaceable between an active deployed position in front of said driver and a storage position.

In a preferred embodiment of the present invention there is provided an adaptable and removable, without tools, personal protection apparatus for use in vehicles comprising: a behind-the-seat ballistic shield provided with means for mounting to the back surface of the drivers seat, said shield being provided with support means extending to the floor of said vehicle for distributing a weight component of said shield, and a deployable protective ballistic shield and visor articulately linked to said behind-the-seat ballistic shield for protecting the upper chest, neck and head areas of a driver and displaceable between an active deployed position in front of said driver and a storage position.

It is to be understood that while the invention is described in terms of the driver and the driver's seat, the above embodiment is also intended for use and the terminology intended to include the mounting of the apparatus on the front passenger's seat as well.

In other preferred embodiments of the present invention said ballistic shield is integrally formed into the backrest of a seat of a vehicle and this embodiment is especially useful for rear and bench seats as well as for truck seats which are not provided with space behind them for installation of the embodiment of the invention incorporating means for mounting to the back surface of the driver's seat.

In a preferred embodiment of the present invention there is provided a personal protection apparatus for use in vehicles wherein said visor has at least one transparent sector.

In another preferred embodiment of the present invention there is provided a personal protection apparatus for use in vehicles wherein said visor is made of polycarbonate.

In a further preferred embodiment of the present invention there is provided a personal protection apparatus for use in vehicles wherein said visor is linked to said behind-the-seat ballistic shield by an articulated track.

In yet a further preferred embodiment of the present invention there is provided a personal protection apparatus for use in vehicles wherein said visor is linked to said behind-the-seat ballistic shield by hinged means.

In a further preferred embodiment of the present invention there is provided a personal protection apparatus for use in vehicles wherein storage position is substantially parallel to said behind-the-seat ballistic shield.

In another preferred embodiment of the present invention there is provided a personal protection apparatus for use in vehicles wherein storage position is substantially above the head of said driver.

In another preferred embodiment of the present invention there is provided a personal protection apparatus for use in vehicles wherein said visor is urged by spring means to remain at both deployed and stored positions.

In yet another preferred embodiment of the present invention there is provided a personal protection apparatus for use in vehicles wherein said behind-the-seat ballistic shield is made of steel. In further embodiments said shield is made of a synthetic fiber textile in a rigid frame or as a composite ceramic armor panel.

In especially preferred embodiments of the present invention said deployable protective visor includes a component which remains deployed above the head of the user in the deployed position of the visor.

It will thus be realized that the novel device of the present invention serves to provide a ballistic shield adaptable to and usable in almost all vehicles. To attain this object the apparatus generally comprises a behind-the-seat mountable surface made of bullet resistant materials with sides extending at an angle from the edges of the panel toward the front of the vehicle driver or passenger to provide ballistic protection from rearward fired projectiles and side angle originating projectiles with a mounting apparatus to attach the shield to the vehicle seat with straps, magnets and/or Velcro type attachments. The behind-the-seat mounted shield provides the mounting point for a ballistic visor made of bullet resistant material that protects the head, neck and upper torso from projectiles fired from the front, side and from a high angle. The visor is made completely or partly from transparent bullet resistant materials and is curved so as to overlap the side panels of the rear of the seat-mounted-shield when in the deployed position. The visor can be positioned behind-the-seat or over the head of the driver and protects the upper chest and neck of the driver.

A small bullet resistant visor can be pushed up and over to its storage position behind-the-seat. In preferred embodiments, the rear mounted protective shield provides the basis for the pivoting or tilting visor.

Thus the advantages of small area armor are combined with an advanced degree of protection for the vehicle occupants.

In especially preferred embodiments of the present invention there can be provided further armor panels extendable from the behind the seat ballistic shield for protecting the lower torso of the user as well. This further armor can be hinged to swing to the side when entering and exiting the car or designed to be deployed simultaneously with the visor.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

There is seen in FIG. 1 an adaptable and removable personal protection apparatus 10 for use in vehicles.

A behind-the-seat ballistic shield 12 is provided with means 14 for mounting to the back surface 16 of the driver's seat 18. The preferred means 14 comprises of at least one strap which is provided with fastening means, such as Velcro pads. In a further embodiment which are not shown, means 14 comprise magnets attached to the inner face of the shield 12, and in yet a further embodiment means 14 is a bungee rubber cord.

The behind-the-seat shield 12 is provided with at least one adjustable support leg 20 extending to the floor 22 of the vehicle 24, for supporting the weight of the shield 12 and of the parts attached thereto.

A visor 26 is positionable for protecting the upper chest, neck and head areas of a driver 28. The visor 26 is displaceable to either an active deployed position in front of the driver 28 as seen in the figure, or to a storage position 29, shown in broken lines when the visor 26 is not needed. In the present embodiment the visor 26 is made of steel, a slot 34 giving the driver an adequate field of view.

Also in the present embodiment the visor 26 is linked to the behind-the-seat ballistic shield 12 by a hinge arrangement 30, struts 32 being provided at each side to support and position the visor 26.

The visor storage position shown is substantially above the head of the driver 28.

Figure 1B:
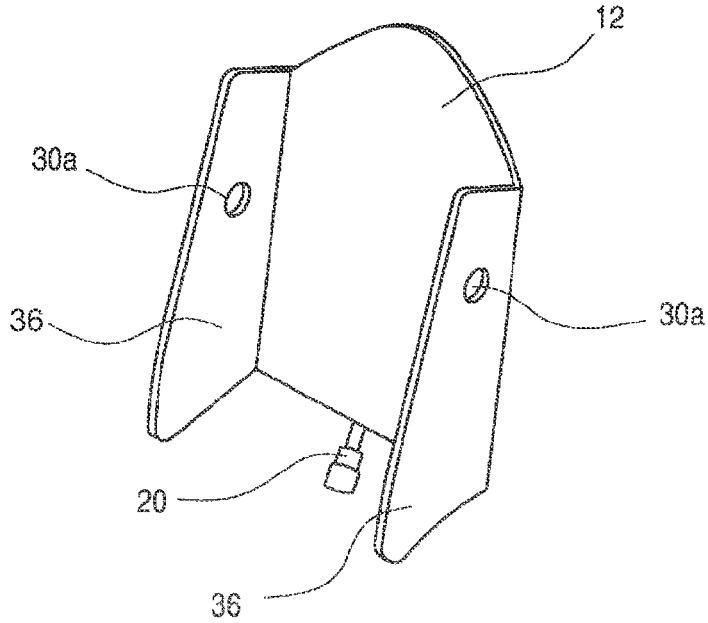
FIG. 1*b* is a perspective view of a shield providing rear and side protection.

Side protection panels 36, seen in FIG. 1*b*, are provided in this and all other embodiments. For clarity of illustration they are not shown in FIG. 1*a*.

With regard to the rest of the figures, similar reference numerals have been used to identify similar parts.

FIG. 1*b* shows behind-the-seat ballistic shield 12 integral with side protection panels 36. The two apertures 30*a* in the panels 36 are functionally part of the visor hinge arrangement 30. A single height-adjustable leg 20 supports the weight of the shield 12. The material of construction in the present embodiment is steel. For a moderate increase of material cost an alloy steel could be used, reducing the necessary thickness of the shield 12 and thus reducing the weight thereof.

Figure 2:
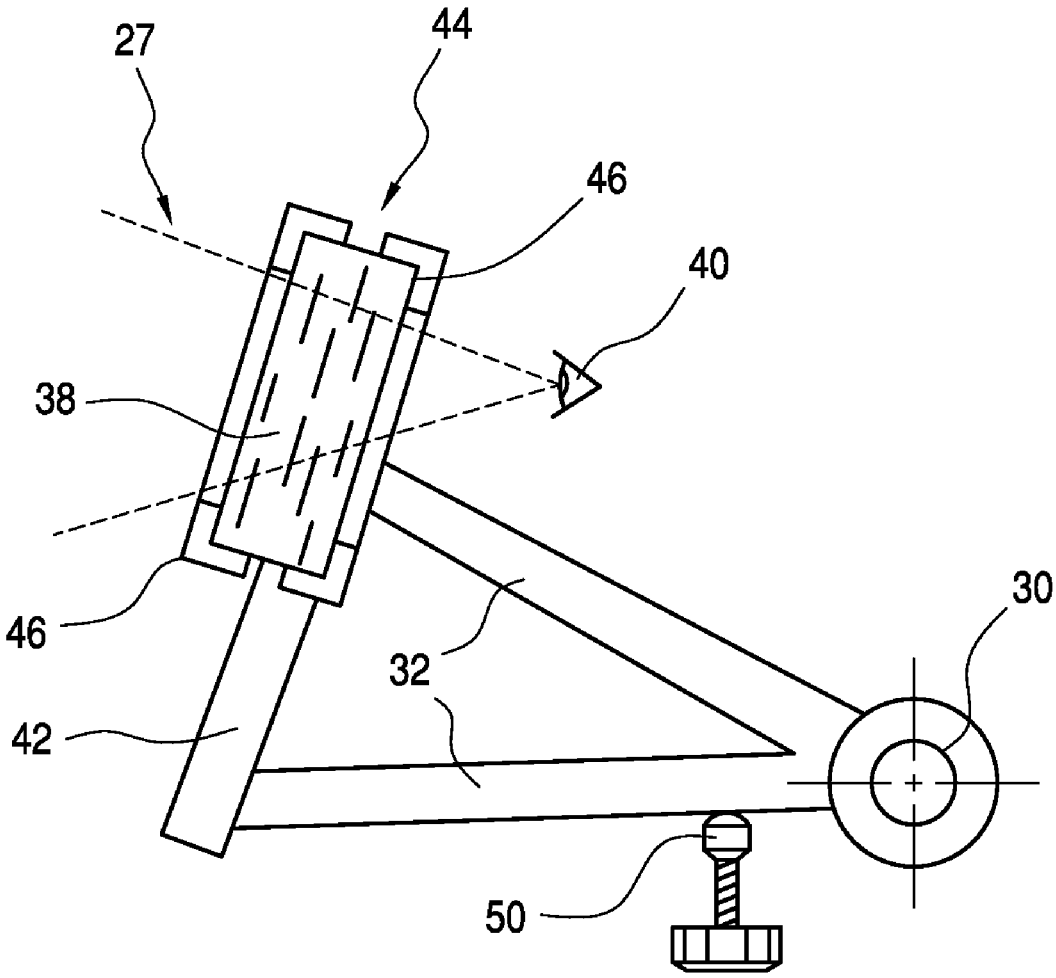
FIG. 2 is an elevational view of a visor provided with an upper transparent part.

Referring now to FIG. 2, there is seen a further embodiment of a visor 27. A transparent sector 38 is disposed in an area proximate to the eyes 40 of a driver. The visor 27 provides a wider field of view than is available in the embodiment 10 seen in FIG. 1. In the present figure there is seen a lower part 42 made of steel, an upper part 44 made of a transparent material (armored glass or polycarbonate) held in a frame 46 attached to the lower part. The frame in an optional item, as the lower and upper parts could overlap and be directly attached to each other.

Again as in FIGS. 1*a* and 1*b*, visor 27 is linked to the behind-the-seat ballistic shield 12, seen in FIGS. 1*a* and 1*b*, by a hinge arrangement 30, struts 32 being provided at each side to support and position the visor 27.

An adjustable stop unit 50 is provided to suit drivers of varying height.

Figure 3:
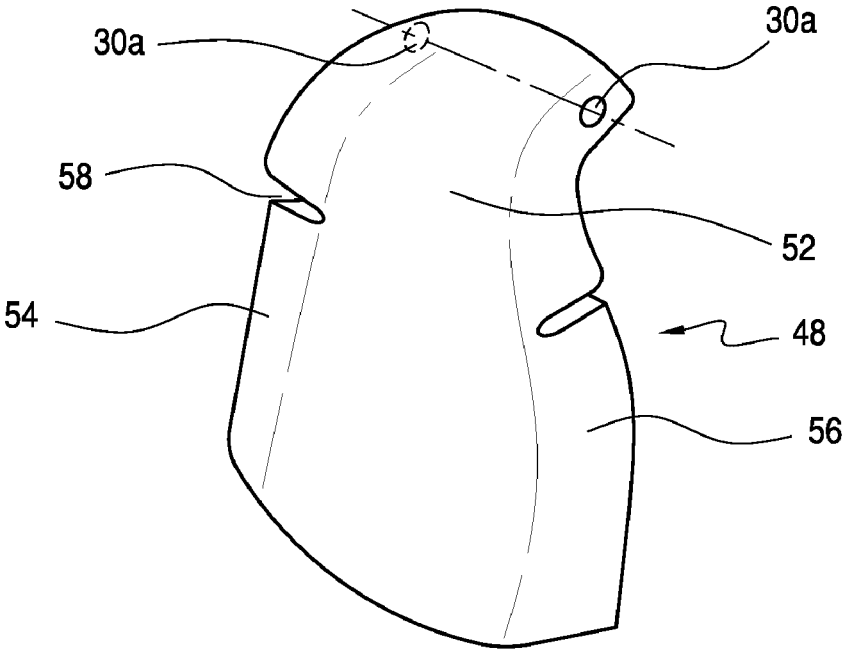
FIG. 3 is a perspective view of a totally transparent visor.

FIG. 3 illustrates a third embodiment of a visor 48 made entirely of polycarbonate. The visor 48 is lighter but thicker than the steel visor 26 described with reference to FIG. 1*a*. The visor 48 is easily molded or hot-bent to its desired shape, providing manufacturing advantages.

The visor comprises of a front face 52 curved in two dimensions. Depending side walls 54, 56 support two apertures 30*a* which are a part of the hinge arrangement 30 of the visor. The slots 58 are part of an arrangement for optional fastening the visor to side protection panels 36 seen in FIG. 1*b*.

Figure 4:
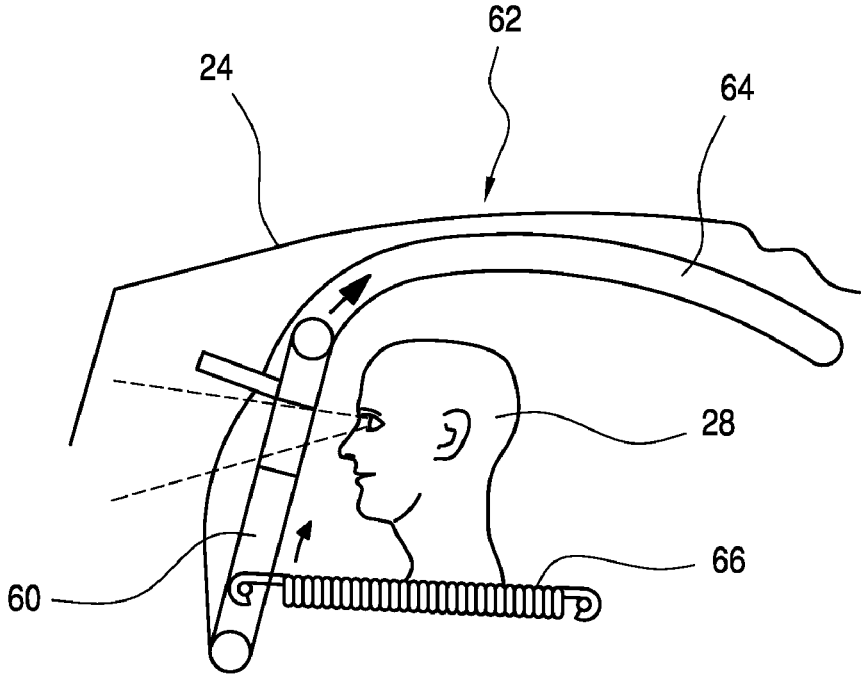
FIG. 4 is an elevational view of a track-guided visor arrangement for overhead storage.

Seen in FIG. 4 is further embodiment of the mechanism related to the visor 60 in the protection apparatus 62 for use in vehicles. In the present embodiment the visor 60 is linked to the behind-the-seat ballistic shield (12 seen in FIG. 1) by an articulated track 64.

The visor storage position is substantially above and slightly behind the head of the driver 28. This position, seen in FIG. 1*a*, thus provides some additional protection from incoming projectiles. The visor 60 is guided by a curved articulated track 64.

Advantageously the visor 60 is urged by a single coil tension spring 66 to remain at both deployed and stored positions and thus to prevent vibration of the visor 60 at either extremities of the articulated track 64

Figure 5:
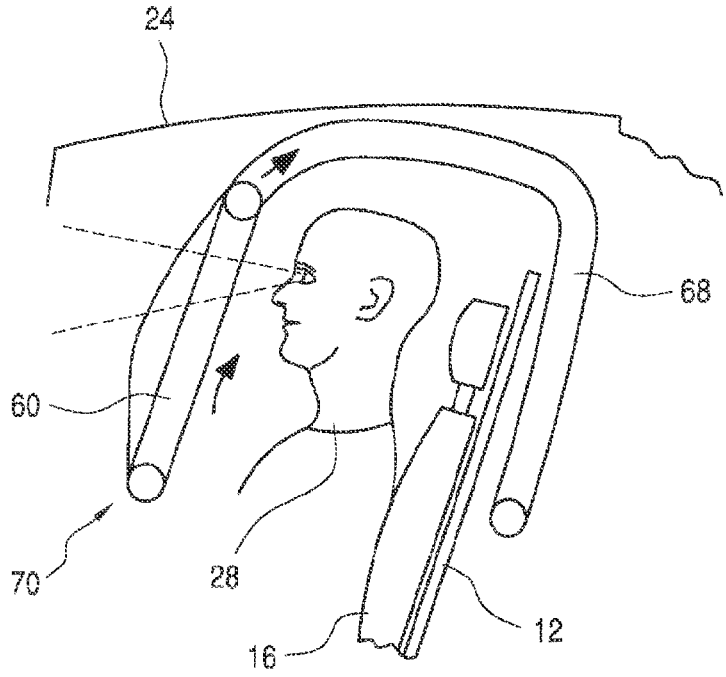
FIG. 5 is an elevational view of a track-guided visor arrangement for behind the seat storage.

Turning now to FIG. 5, there is seen in the figure an embodiment 70 provided with an articulated track 68 which is longer than the track 64 seen in FIG. 4. The track 68 allows storage of the visor 60 at the rear of the behind-the-seat ballistic shield 12 and thus allows the driver 28 an unobstructed rear view.

Figure 6:
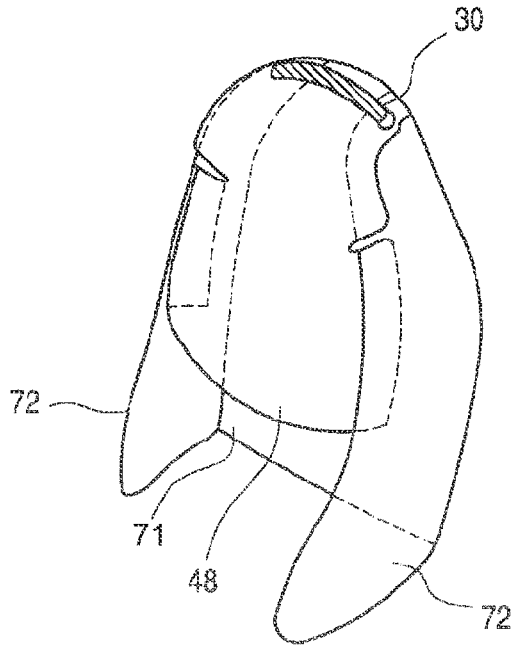
FIG. 6 is a perspective view of a hinged transparent visor revolvably attached to a transpare.

With reference now to FIG. 6, there is seen a visor 48, as shown and described in FIG. 3, hinged to and supported by a behind-the-seat ballistic shield 71 integrally molded to with side protection panels 72. The visor 48 fits into the space between the two panels 72.

Both the visor 48 and the behind-the-seat ballistic shield 71 are made of a transparent grade of polycarbonate, offering the driver a maximum field of view.

It will be evident to those skilled in the art that the invention is not limited to the details of the foregoing illustrative embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A personal protection apparatus for use in an automobile, comprising:

a behind-the-seat first ballistic shield having support means fixed centrally behind said first ballistic shield extending to and contacting a floor of said automobile for distributing a weight component of said behind-the-seat ballistic shield; and a second ballistic shield and a visor articulately linked to said first ballistic shield protecting an upper chest, neck and head areas of a driver from fired ballistic threats and displaceable between an active deployed position in front of said driver and a storage position.

2. The personal protection apparatus according to claim 1, wherein said visor has at least one transparent sector.

3. The personal protection apparatus according to claim 2, wherein at said visor is made of polycarbonate.

4. A personal protection apparatus according to claim 1 for use in vehicles wherein said visor is linked to said behind-the-seat ballistic shield by an articulated track.

5. The personal protection apparatus according to claim 1, wherein said visor is linked to said behind-the-seat ballistic shield by hinged means.

6. A personal protection apparatus for use in vehicles according to claim 1 wherein storage position is substantially parallel to said behind-the-seat ballistic shield.

7. The personal protection apparatus according to claim 1, wherein storage position is substantially above the head of said driver.

8. A personal protection apparatus for use in vehicles according to claim 7 wherein said visor is urged by spring means to remain at both deployed and stored positions.

9. The personal protection apparatus according to claim 1, wherein said behind-the-seat ballistic shield is made of steel.

10. The personal protection apparatus according to claim 1, wherein said behind-the-seat ballistic shield is made of a synthetic fiber textile in a rigid frame.

11. The personal protection apparatus according to claim 1, wherein said behind-the-seat ballistic shield is made as a composite ceramic armor panel.

12. The personal protection apparatus according to claim 1, wherein said ballistic shield is attached to the backrest of a seat of a vehicle.

13. The personal protection apparatus according to claim 1, wherein said deployable protective visor includes a component which remains deployed above the head of the user in the deployed position of the visor.

* * * * *